United States Patent [19]

Abe

[11] Patent Number: 4,747,385

[45] Date of Patent: May 31, 1988

[54] AIR-FUEL RATIO CONTROL SYSTEM FOR AN AUTOMOTIVE ENGINE

[75] Inventor: Kunihiro Abe, Mitaka, Japan

[73] Assignee: Fuji Jukogyo Kabushiki Kaisha, Tokyo, Japan

[21] Appl. No.: 936,474

[22] Filed: Nov. 26, 1986

[30] Foreign Application Priority Data

Nov. 29, 1985 [JP] Japan ..... 60-268917

[51] Int. Cl.[4] ..... F02M 7/18

[52] U.S. Cl. ..... 123/479; 123/440

[58] Field of Search ..... 123/489, 480, 440, 494, 123/479

[56] References Cited

U.S. PATENT DOCUMENTS

| | | | |
|---|---|---|---|
| 4,309,971 | 1/1982 | Chiesa | 123/440 |
| 4,348,728 | 9/1982 | Sagisaka | 123/489 |
| 4,397,279 | 8/1983 | Iida | 123/489 |
| 4,430,976 | 2/1984 | Kondo | 123/480 |
| 4,434,764 | 3/1984 | Hasegawa | 123/489 |
| 4,582,038 | 4/1986 | Canta | 123/480 |
| 4,638,658 | 1/1987 | Otobe | 123/440 |

*Primary Examiner*—Ronald B. Cox

*Attorney, Agent, or Firm*—Martin A. Farber

[57] ABSTRACT

An air-fuel ratio control system has a system for updating data stored in a table at a steady state of engine operation in accordance with output voltage of an $O_2$-sensor. When the output voltage deviates from a reference voltage corresponding to a stoichiometric air-fuel ratio during a predetermined period, the data is rewritten to a fail safe value.

6 Claims, 7 Drawing Sheets

AIR-FUEL RATIO CONTROL SYSTEM FOR AN AUTOMOTIVE ENGINE

BACKGROUND OF THE INVENTION

The present invention relates to a system for controlling air-fuel ratio of mixture for an automotive engine, and more particularly to a learning control system for updating data stored in a table for the learning control.

In the learning control system, the updating of data is performed with new data obtained during the steady state of engine operation. Accordingly, means for determining whether the engine operation is in steady state is necessary. A conventional learning control system (for example U.S. Pat. No. 4,309,971) has a matrix (two-dimensional lattice) comprising a plurality of the divisions, each representing engine operating variables such as engine speed and engine load. When the variables continue for a predetermined period of time in one of divisions, it is determined that the engine is in steady state. On the other hand, a three-dimensional look-up table is provided, in which a matrix coincides with the matrix for determining the steady state. Data in the look-up table is updated with new data obtained during steady states.

In such a system if a sensor for obtaining information for updating data deteriorates and fails to produce a proper output signal, old data are rewritten by improper data. In case of a learning control system for controlling the air-fuel ratio of air-fuel mixture for a motor vehicle, an $O_2$-sensor is employed for obtaining information of the air-fuel ratio. If the $O_2$-sensor does not produce a proper output signal, the driveability of the vehicle decreases and fuel consumption increases.

SUMMARY OF THE INVENTION

The object of the present invention is to provide a system which may eliminate problems caused by the failure of a sensor, such as an increase of the fuel consumption of an engine.

In the system of the present invention, the failure of an $O_2$-sensor is determined by detecting the deviation of the output voltage of the $O_2$-sensor from a reference voltage corresponding to a stoichiometric air-fuel ratio during a predetermined period. When the failure is detected, the data in the table is rewritten to a fail safe value.

According to the present invention, there is provided a system for controlling air-fuel ratio of mixture for an automotive engine by updated data, comprising, a table storing data, an $O_2$-sensor for detecting oxygen concentration of exhaust gases of the engine and for producing an output voltage dependent on the concentration, first means for updating the data in the table with a value relative to the output voltage, second means for detecting deviations of the output voltage from a reference voltage corresponding to a stoichiometric air-fuel ratio and for producing a deviation signal, third means for detecting continuation of the deviation signal during a predetermined period and for producing a continuation signal, and fourth means responsive to the continuation signal for rewriting data in the table to fail safe value.

The other objects and features of this invention will become understood from the following description with reference to the accompanying drawings.

DETAILED DESCRIPTION OF THE PREFERRED EMBODIMENT

Figure 1:
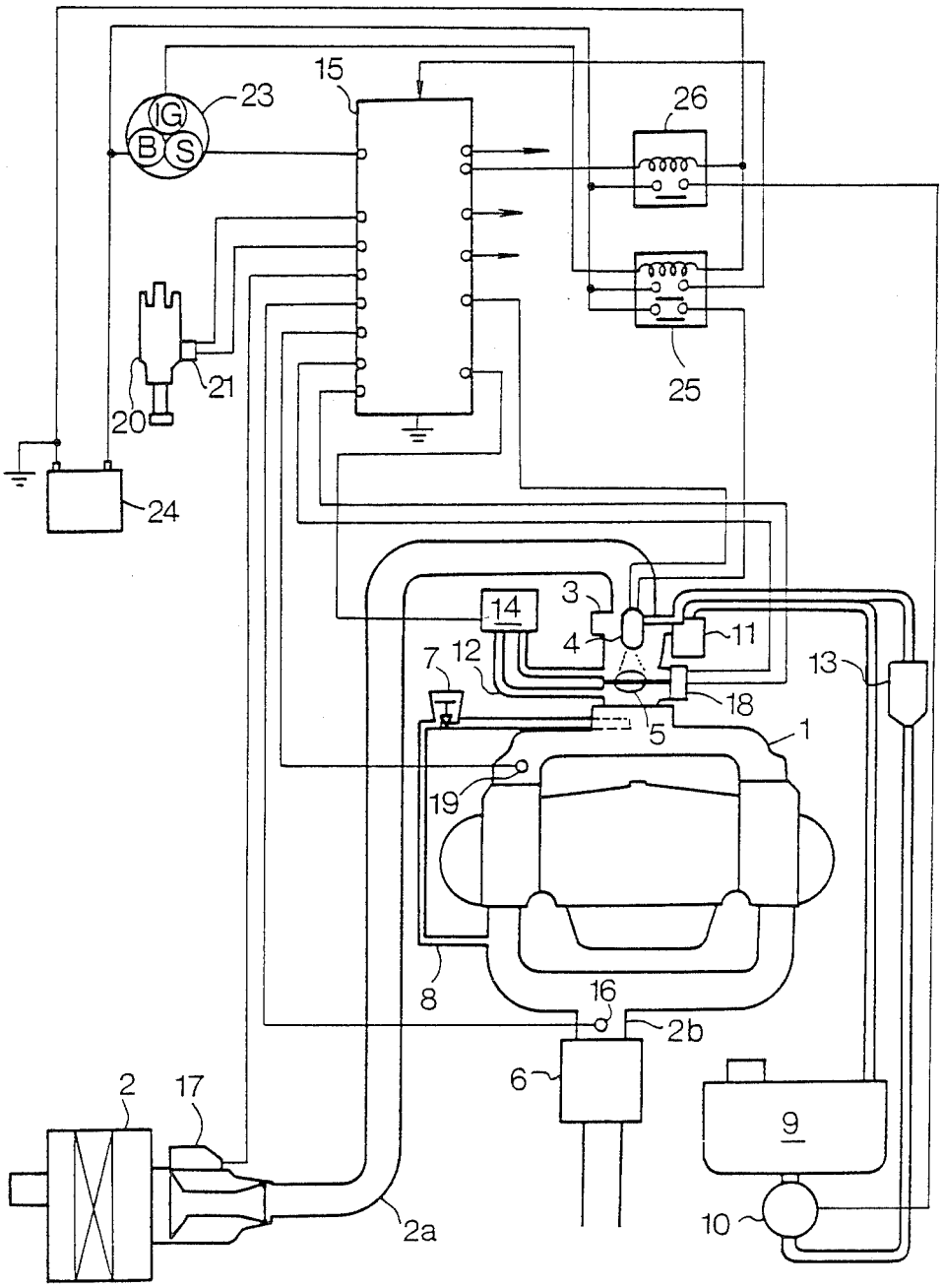
FIG. 1 is a schematic illustration showing a system for controlling the operation of an internal combustion engine for a motor vehicle.

Referring to FIG. 1, an internal combustion engine 1 for a motor vehicle is supplied with air through an air cleaner 2, intake pipe 2*a,* and throttle valve 5 in a throttle body 3, mixing with fuel injected from an injecter 4. A three-way catalitic converter 6 and an $O_2$-sensor 16 are provided in an exhaust passage 2*b.* An exhaust gas recirculation (EGR) valve 7 is provided in an EGR passage 8 in a well known manner.

Fuel in a fuel tank 9 is supplied to the injector 4 by a fuel pump 10 through a filter 13 and pressure regulator 11. A solenoid operated valve 14 is provided in a bypass 12 around the throttle valve 5 so as to control engine speed at idling operation. A mass air flow meter 17 is provided on the intake pipe 2*a* and a throttle position sensor 18 is provided on the throttle body 3. A coolant temperature sensor 19 is mounted on the engine. Output signals of the meter 17 and sensors 16, 18 and 19 are applied to a microcomputer 15. The microcomputer 15 is also applied with a crankangle signal from a crankangle sensor 21 mounted on a distribution 20 and a starter signal from a starter switch 23 which operates to turn on-off electric current from a battery 24. The system is further provided with an injector relay 25 and a fuel pump relay 26 for operating the injector 4 and fuel pump 10.

Figure 2:
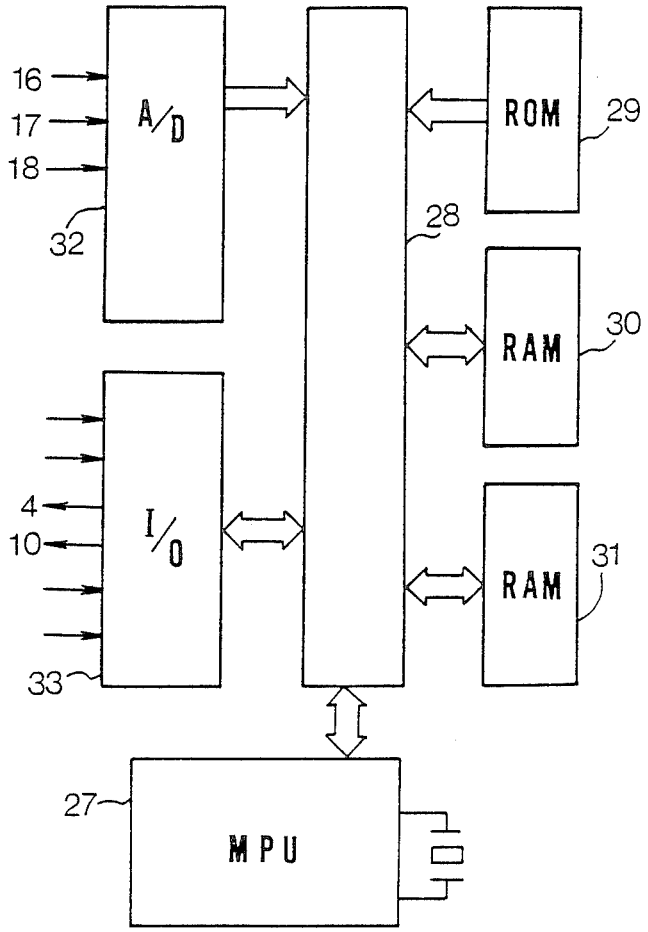
FIG. 2 is a block diagram of a microcomputer system used in a system of the present invention.

Referring to FIG. 2, the microcomputer 15 comprises a microporcessor unit 27, ROM 29, RAM 30, RAM 31 with back-up, A/D converter 32 and I/O interface 33. Output signals of $O_2$-sensor 16, mass air flow meter 17 and throttle position sensor 18 are converted to digital signals and applied to the microprocessor unit 27 through a bus 28. Other signals are applied to the microprocessor unit 27 through I/O interface 33. The microprocessor manipulates input signals and executes hereinafter described process.

In the system, the amount of fuel to be injected by the injector 4 is determined in accordance with engine operating variables such as mass air flow, engine speed and engine load. The amount of fuel is decided by a fuel injector energization time (injection pulse width). Basic injection pulse width ($T_p$) can be obtained by the following formula.

$$T_p = K \times Q/N \quad (1)$$

where Q is mass air flow, N is engine speed, and K is a constant.

Desired injection pulse width ($T_i$) is obtained by correcting the basic injection pulse ($T_p$) with engine operating variables. The following is an example of a formula for computing the desired injection pulse width.

$$T_i = T_p \times (\text{COEF}) \times \alpha \times K_a \quad (2)$$

where COEF is a coefficient obtained by adding various correction or compensation coefficients such as coefficients dependent on coolant temperature, full throttle open, engine load, etc., $\alpha$ is a $\lambda$ correcting coefficient (the integral of the feedback signal of the $O_2$-sensor 16), and $K_a$ is a correcting coefficient by learning (hereinafter called learning control coefficient). Coefficients, such as coolant temperature coefficient and engine load, are obtained by looking up tables in accordance with sensed informations.

Figure 3A:
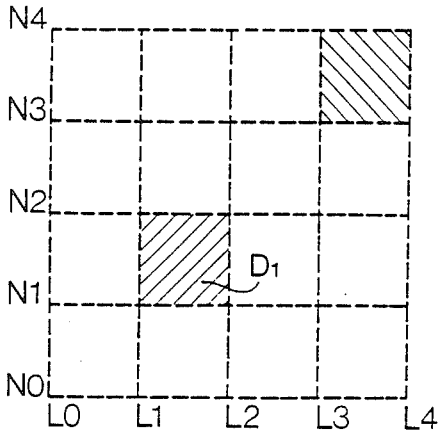
FIG. 3*a* is an illustration showing a matrix for detecting the steady state of engine operation.

The learning control coefficients $K_a$ stored in a $K_a$-table are updated with data calculated during the steady state of engine operation. In the system, the steady state is determined by engine operating conditions in predetermined ranges of engine load and engine speed and continuation of a detected state. FIG. 3*a* shows a matrix for the detection, which comprises, for example sixteen divisions defined by five row lines and five column lines. Magnitudes of engine load are set at five points $L_0$ to $L_4$ on the X axis, and magnitudes of engine speed are set at five points $N_0$ to $N_4$ on the Y axis. Thus, the engine load is divided into four ranges, that is $L_0$–$L_1$, $L_1$–$L_2$, $L_2$–$L_3$, and $L_3$–$L_4$. Similarly, the engine speed is divided into four ranges.

Figure 4A:
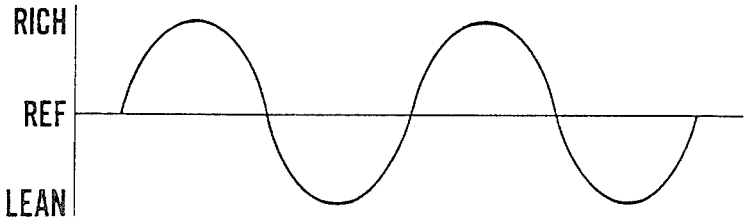
FIG. 4*a* shows the output voltage of an $O_2$-sensor.

On the other hand, the output voltage of the $O_2$-sensor 16 cyclically changes through a reference voltage corresponding to a stoichiometric air-fuel ratio, as shown in FIG. 4*a*. Namely, the voltage changes between high and low voltages corresponding to rich and lean air-fuel mixtures. In the system, when the output voltage (feedback signal) of the $O_2$-sensor continues during predetermined cycles, for example three cycles within one of sixteen divisions in the matrix, the engine is assumed to be in steady state.

Figure 3B:
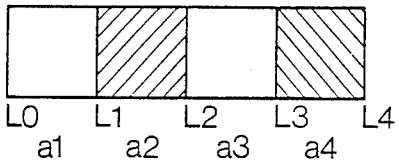
FIG. 3*b* shows a table for learning control coefficients.

FIG. 3*b* shows a $K_a$-table for storing the learning control coefficients $K_a$, which is included in the RAM 31 of FIG. 2. The $K_a$-table is a two-dimensional table and has addresses $a_1$, $a_2$, $a_3$, and $a_4$ which correspond to engine load ranges $L_0$–$L_1$, $L_1$–$L_2$, $L_2$–$L_3$, and $L_3$–$L_4$. All of the coefficients $K_a$ stored in the $K_a$-table are initially set to the same value, that is the numerical value "1". This is caused by the fact that the fuel supply system is to be designed to provide the most proper amount of fuel without the coefficient $K_a$. However, every automobile can not be manufactured to have a desired function, resulting in same results. Accordingly, the coefficient $K_a$ should be updated by learning at every automobile, when it is actually used.

Figure 4B:
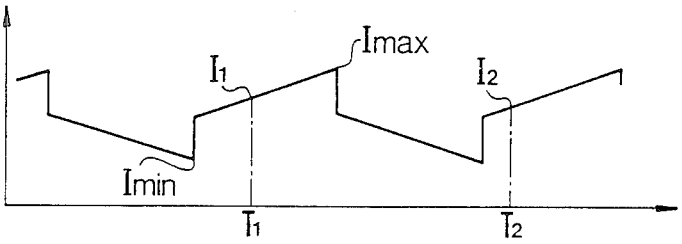
FIG. 4*b* shows the output voltage of an integrator.

Explaining the calculation of the injection pulse width ($T_i$ in formula 2) at starting of the engine, since the temperature of the body of the $O_2$-sensor 16 is low, the output voltage of the $O_2$-sensor is very low. In such a state, the system is adapted to provide "1" as value of correcting coefficient $\alpha$. Thus, the computer calculates the injection pulse width ($T_i$) from mass air flow (Q), engine speed (N), (COEF), $\alpha$ and $K_a$. When the engine is warmed up and the $O_2$-sensor becomes activated, an integral of the output voltage of the $O_2$-sensor at a predetermined time is provided as the value of $\alpha$. More particularly, the computer has a function of an integrator, so that the output voltage of the $O_2$-sensor is integrated. FIG. 4*b* shows the output of the integrator. The system provides values of the integration at a predetermined interval (40 ms). For example, in FIG. 4*b*, integrals $I_1$, $I_2$---at times $T_1$, $T_2$---are provided. Accordingly, the amount of fuel is controlled in accordance with the feedback signal from the $O_2$-sensor, which is represented by integral.

Explaining the learning operation, when steady state of engine operation is detected in one of the divisions of the matrix, data in a corresponding address of the $K_a$-table is updated with a value relative to the feedback signal from the $O_2$-sensor. The first updating is done with an arithmetical average (A) of maximum value and minimum value in one cycle of the integration, for example values of Imax and Imin of FIG. 4*b*. Thereafter, when the value of $\alpha$ is not 1, the $K_a$-table is incremented or decremented with a minimum value ($\Delta$A) which can be obtained in the computer. Namely one bit is added to or subtracted from a BCD code representing the value A of the coefficient $K_a$ which has been rewritten at the first learning.

Figure 7A:
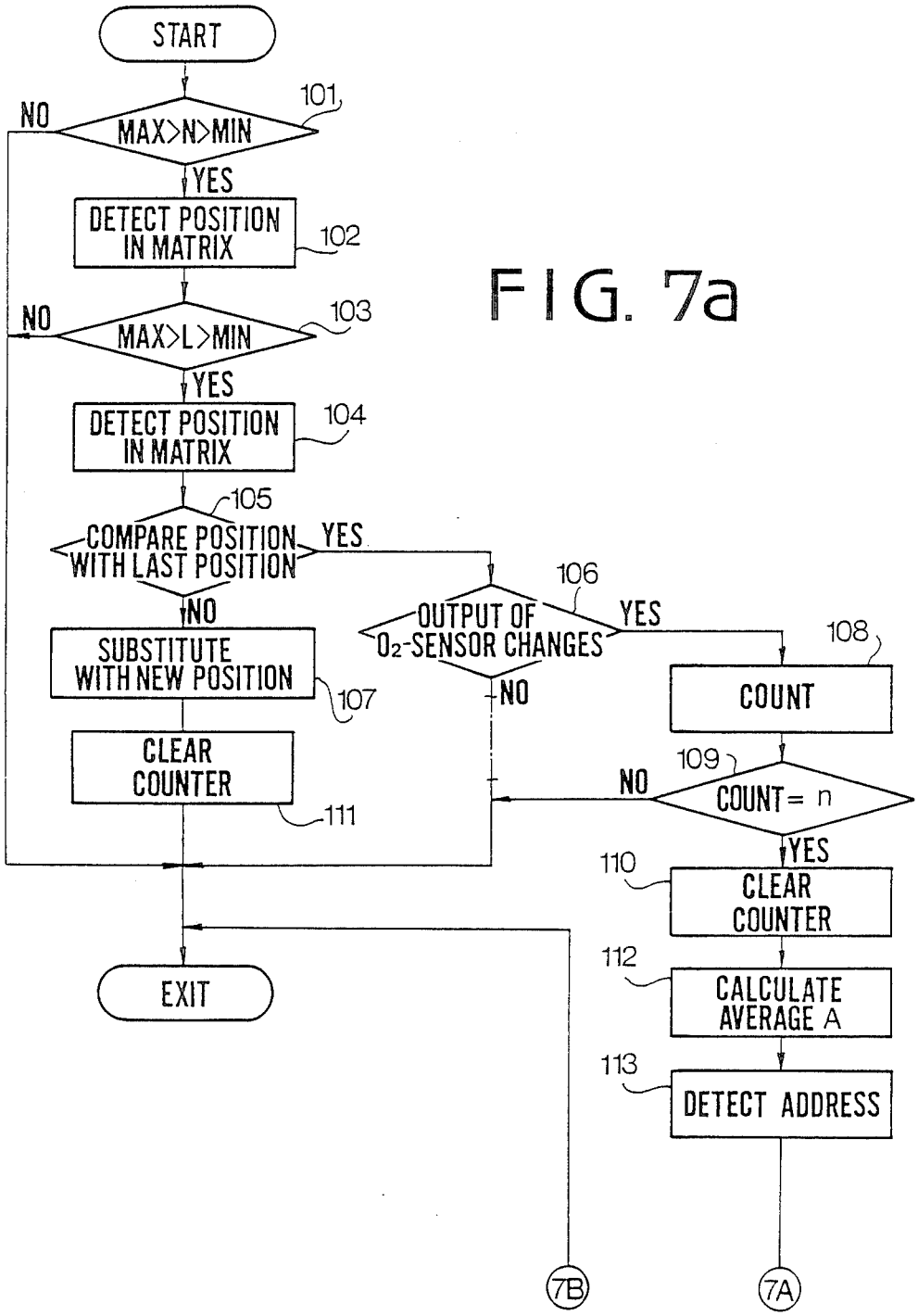
FIGS. 7*a,* 7*b* and 8 are flowcharts showing the operation in an embodiment of the present invention.
Figure 7B:
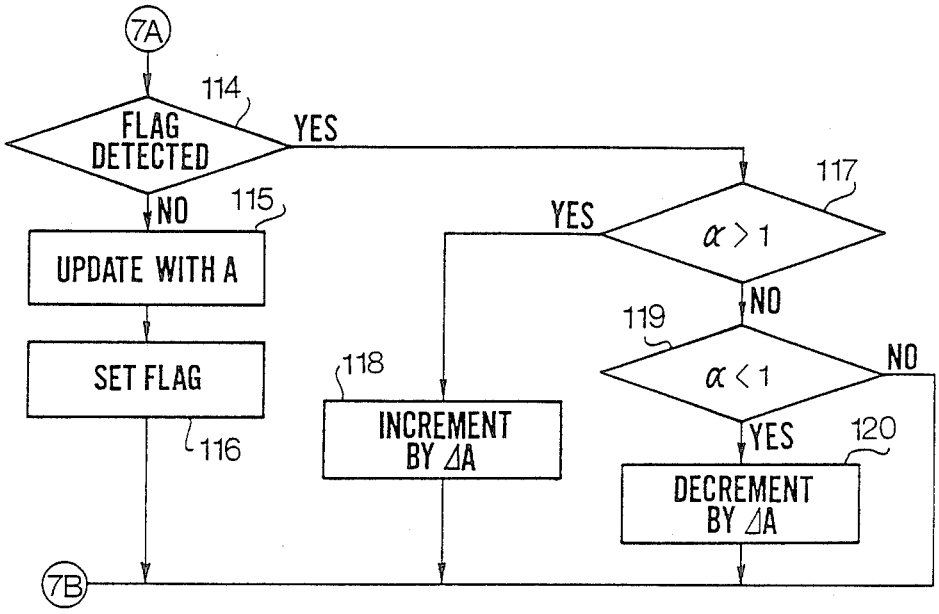

The operation of the system will be described in more detail with reference to FIGS. 7*a*, 7*b*. The learning program is started at a predetermined interval (40 ms). At the first operation of the engine and the first driving of the motor vehicle, engine speed N is detected at step 101. If the engine speed N is within the range between $N_0$ and $N_4$, the program proceeds to a step 102. If the engine speed N is out of the range, the program exits the routine. At step 102, the position of the row of the matrix of FIG. 3*a* in which the detected engine speed is included is detected and the position is stored in RAM 30. Thereafter, the program proceeds to a step 103, where engine load L is detected. If the engine load L is within the range between $L_0$ and $L_4$, the program proceeds to a step 104. If the engine load L is out of the range, the program exits the routine. Thereafter, the position of column corresponding the detected engine load is detected in the matrix, and the position is stored in the RAM 30. Thus, the position of division corresponding to the engine operating condition represented by engine speed and engine load is decided in the matrix, for example, division $D_1$ is decided in FIG. 3*a*. The program advances to a step 105, where the detected position of the division is compared with the division which has been detected at the last learning. However, since the learning is the first, the comparison can not be performed, and hence the program is terminated passing through steps 107 and 111. At the step 107, the position of the division is stored in RAM 30.

At a learning after the first learning, the detected position is compared with the last stored position of the division at step 105. If the position of the division in the matrix is the same as the last learning, the program proceeds to a step 106, where the output voltage of $O_2$-sensor 16 is compared with the reference voltage in FIG. 4*a*. If the voltage changes from rich to lean and vice versa, the program goes to a step 108. If the output voltage deviates from the reference voltage and fluctuates without crossing the line of the reference voltage, the program proceeds to a step 121 of FIG. 8, as described hereinafter. At the step 108, the number of the cycle of the output voltage is counted by a counter. If the counter counts up to a predetermined number n, for example three, the program proceeds to a step 110 from a step 109. If the count does not reach three, the program is terminated. At the step 110, the counter is cleared and the program proceeds to a step 112.

On the other hand, if the position of the division is not the same as the last learning, the program proceeds from step 105 to step 107, where the old data of the position is substituted with the new data.

At step 112, the arithmetical average A of maximum and minimum values of the integral of the output voltage of the $O_2$-sensor at the third cycle of the output waveform is calculated and the value A is stored in the RAM. Thereafter, the program proceeds to a step 113, where the address corresponding to the position of the division is detected, for example, the address $a_2$ corresponding to the division $D_1$ is detected.

Thereafter, the program proceeds to a step 114, where a flag in the stored address is detected. Since, before the instant learning, no flag was set, the program proceeds to a step 115. At step 115, the learning control coefficient Ka in the address of the Ka-table of FIG. 3*b* is entirely updated with the new value A, that is the arithmetical average obtained at step 112, and the program proceeds to a step 116. At the step 116, the flag is set in the address, the thereafter the program is terminated.

At a learning after the first updating, if the flag exists in the address, the program proceeds from step 114 to a step 117, where it is determined whether the value of $\alpha$ (the integral of the output of the $O_2$-sensor) at the learning is larger than "1". If $\alpha$ is larger than "1", the program proceeds to a step 118, where the minimum unit $\Delta A$ (one bit) is added to the learning control coefficient Ka in the corresponding address. If $\alpha$ is less than "1", the program proceeds to a step 119, where it is determined whether $\alpha$ is less than "1". If $\alpha$ is less than "1", the minimum unit $\Delta A$ is subtracted from Ka at a step 120. If $\alpha$ is not less than "1", which means that $\alpha$ is "1", the program exits the updating routine. Thus, the updating operation continues untl the value of $\alpha$ becomes "1".

Figure 5:
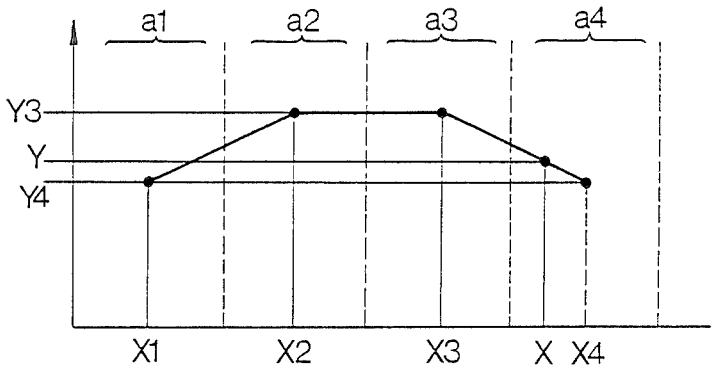
FIG. 5 shows a linear interpolation for reading the table of FIG. 3*b;*

When the injection pulse width ($T_i$) is calculated, the learning control coefficient $K_a$ is read out from the $K_a$-table in accordance with the value of engine load L. However, the values of $K_a$ are stored at intervals of loads. FIG. 5 shows an interpolation of the $K_a$-table. At engine loads $X_1$, $X_2$, $X_3$, and $X_4$, updated values $Y_3$ and $Y_4$ (as coefficient K) are stored. When the detected engine load does not coincide with the set loads $X_1$ to $X_4$, coefficient $K_a$ is obtained by linear interpolation. For example, the value Y of $K_a$ at engine load X is obtained by the following formula.

$$Y=((X-X_3)/(X_4-X_3))\times(Y_4-Y_3)+Y_3$$

Figure 6A:
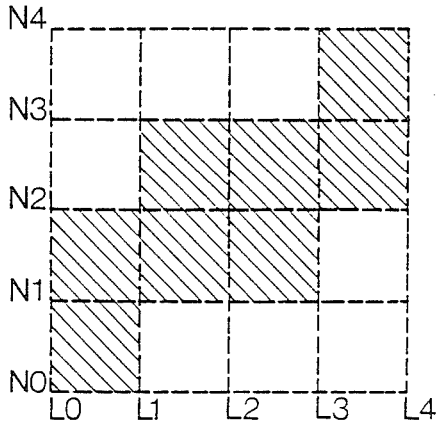
FIGS. 6*a* and 6*b* are illustrations for explaining probability of updating.
Figure 6B:
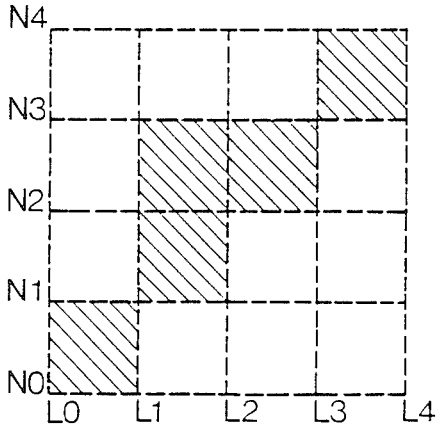

FIG. 6*a* is a matrix pattern showing the updating probability over 50% and FIG. 6*b* is a pattern showing the probability over 70% by hatching divisions in the matrix. More particularly, in the hatched range in FIG. 6*b*, the updating occurs at a probability over 70%. From the figures it will be seen that the updating probability at extreme engine operating steady state, such as the state that at low engine load at high engine speed and at high engine load at low engine speed, is very small. In addition, it is experienced that the difference between values of coefficient $K_a$ in adjacent speed ranges is small. Accordingly, it will be understood that the two-dimensional table, in which a single data is stored at each address, is sufficient for performing the learning control of an engine.

Figure 8:
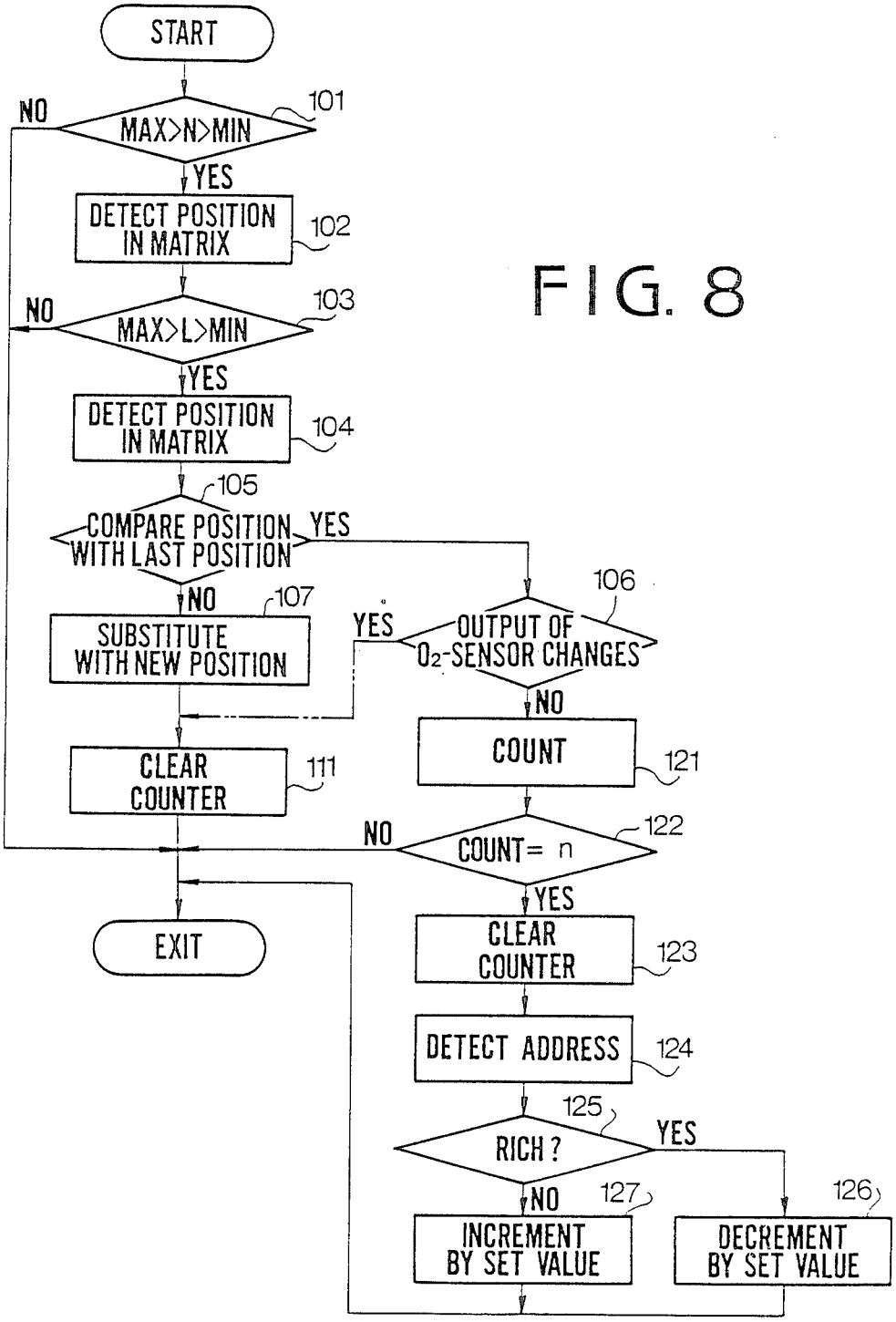

Operation at deterioration in the functioning of the $O_2$-sensor is described hereinafter with reference to FIG. 8. Operation from step 101 to step 106 is the same as the operation of FIG. 7*a*. When the $O_2$-sensor deteriorates in function, the output voltage of the $O_2$-sensor continues to deviate from the reference voltage or does not change and the program proceeds to a step 121 from step 106. Accordingly, at step 121, the period of continuation of deviation of the output voltage is counted by a counter. At a step 122, it is determined whether the count at step 121 exceeds a predetermined number n, for example three. If the count is smaller than the set count, the program is terminated. If not, the program proceeds to a step 123 where the counter is cleared and further to a step 124 where the address corresponding to the division in the matrix is detected. Thereafter, at a step 125, it is determined whether the output voltage is in the rich side (FIG. 4*a*) or in the lean side with respect to the reference voltage. When it is in the rich side, the data in the Ka-table is decremented (rewritten to a fail safe value) with a predetermined value at a step 126. If it is in the lean side, the data is incremented (rewritten to a fail safe value) with a set value at a step 127.

Thus, in accordance with the present invention, the failure of a sensor is detected and fail safe operation is effected to properly maintain engine operation, until the failure is repaired.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A system for controlling air-fuel ratio of air-fuel mixture for an automotive engine by updated data, comprising;

a table storing data at particular addresses;

an $O_2$-sensor for detecting oxygen concentration of exhaust gases of the engine and for producing an output voltage dependent on the concentration;

first means for updating the data in the table with a value relative to the output voltage;

second means for detecting deviation of the output voltage from a reference voltage corresponding to a stoichiometric air-fuel ratio and for producing a deviation signal;

third means for detecting continuation of the deviation signal during a predetermined period and for producing a continuation signal; and fourth means responsive to the continuation signal for rewriting data at one of said particular addresses in the table to a fail safe value dependent on the value of the data existing at that address.

2. A method for controlling air-fuel ratio of an air-fuel mixture in an automotive engine, comprising the steps of determining that engine operation is in a steady state by determining whether two variables of engine operation stay in any one of divisions of a matrix for a predetermined period, the matrix being formed by ranges of the two variables of engine operation, producing a steady state signal when the steady state is determined, storing learning control coefficients in respective divisions of a two-dimensional look-up table having a plurality of divisions arranged in an array, each of the latter divisions having an address corresponding to the ranges of one of said two variables of the matrix, detecting oxygen concentration of exhaust gases of the engine and producing an output voltage dependent on the concentration, providing new data to be used for updating the respective coefficient in accordance with engine operating conditions, updating a coefficient stored in the two-dimensional look-up table with the new data in response to the steady state signal at an address in the two-dimensional look-up table corresponding to the range of said one of said two variables of the matrix occurring in the prevailing steady state, detecting deviation of said output voltage from a reference voltage and producing a deviation signal, detecting if the deviation signal continues for a predetermined period for producing a continuation signal, and rewriting only that coefficient, at an address of the table corresponding to the range of said one of said two variables of the matrix occurring in the prevailing steady state, to a fail safe value in response to the continuation signal and to the steady state signal.

3. A system for updating coefficients of data in an apparatus for controlling air-fuel ratio in an automotive engine by the updated data, the system comprising:

a look-up table for storing coefficients with respect to at least one operating condition of the engine;

first means for detecting an operating condition of the engine and for producing a feedback signal dependent on the latter operating condition;

the apparatus comprising means for controlling the air-fuel ratio dependent on said feedback signal and on the currently prevailing of the coefficients of data in the look-up table;

said system further comprising:

second means for determining that engine operation is in steady state by determining that two variables of engine operation stay in one of divisions of a matrix for a predetermined period, the matrix being formed by ranges of the two variables of engine operation, said second means for producing a steady state signal when the steady state is so determined;

third means for detecting said steady state signal and for producing an updating signal;

fourth means responsive to the updating signal for updating the coefficients of data in the table stored with respect to said at least one operating condition of the engine;

fifth means for controlling the operation of the fourth means until the feedback signal reaches a desired value, sixth means for detecting deviation of said feedback signal from a reference voltage and producing a deviation signal, seventh means for detecting if the deviation signal continues for a predetermined period for producing a continuation signal, and eighth means for rewriting only that coefficient, at an address of the table corresponding to the range of said one of said two variables of the matrix occurring in the prevailing steady state, to a fail safe value in response to the continuation signal and to the steady state signal.

4. The system according to claim 3, wherein said eighth means being responsive to the steady state signal and the continuation signal for rewriting the coefficient to the fail safe value by incrementing and respectively decrementing the coefficient, stored in the table corresponding to a prevailing of said at least one operating condition of the engine with a predetermined value, the incrementing and respectively decrementing depending on if said feedback signal is lean and rich respectively.

5. The system according to claim 3, wherein said seventh means detects said deviation of said feedback signal from said reference voltage when said feedback signal deviates from the reference voltage without crossing said reference voltage or when said feedback signal does not change.

6. The system according to claim 3, wherein said eighth means further for rewriting another coefficient at another address of the table corresponding to another said range of said one of said two variables of the matrix occurring in a new prevailing steady state, to a fail safe value in response to the continuation signal and to the steady state signal, when the first-mentioned steady state has changed to the new prevailing steady state corresponding to another division of said matrix corresponding to said another range of said one of said two variables of the matrix.

* * * * *